United States Patent [19]

Le Dall et al.

[11] 4,229,142

[45] Oct. 21, 1980

[54] ONE-PIECE PUMPING DEVICE WITH AMBIVALENT OPERATION

[75] Inventors: Jean-Claude Le Dall, Rueil-Malmaison; Jean-Claude M. Pasquet, Saint Cloud, both of France

[73] Assignee: Le Materiel Telephonique, Boulogne-Billancourt, France

[21] Appl. No.: 957,918

[22] Filed: Nov. 6, 1978

[30] Foreign Application Priority Data

Nov. 10, 1977 [FR] France ..... 77 33889

[51] Int. Cl.[3] ..... F04B 23/04; F04B 49/02

[52] U.S. Cl. ..... 417/38; 417/62; 417/238; 417/350

[58] Field of Search ..... 417/62, 350, 238, 902, 417/38

[56] References Cited

U.S. PATENT DOCUMENTS

| | | | |
|---|---|---|---|
| 2,687,693 | 8/1954 | Hudson | 417/38 X |
| 2,814,254 | 11/1957 | Litzenberg | 417/350 |
| 3,102,483 | 9/1963 | Najimian et al. | 417/350 |
| 3,228,587 | 1/1966 | Segebrecht | 417/62 |
| 3,347,168 | 10/1967 | Nixon | 417/350 |
| 3,410,218 | 11/1968 | Fivel | 417/350 |
| 3,500,755 | 3/1970 | Gibson | 417/350 X |
| 4,132,504 | 1/1979 | Fitch | 417/238 X |

*Primary Examiner*—Carlton R. Croyle
*Assistant Examiner*—Edward Look
*Attorney, Agent, or Firm*—Roland Plottel

[57] ABSTRACT

A single motor 25 simultaneously drives two pump elements mounted on its shaft ends. The hydraulic circuit, the motor and the pump elements are contained within a one-piece 3-part assembly comprising a central part 2 placed between two end parts 1 and 3. It is merely necessary to change the relative orientation of one of the end parts, the movable part 1, through 180° in order to couple the two pump elements in series or in parallel as required. The pumping device operates immersed.

Suitable for several applications to meet domestic and light industrial requirements.

9 Claims, 4 Drawing Figures

ONE-PIECE PUMPING DEVICE WITH AMBIVALENT OPERATION

BACKGROUND OF THE INVENTION (a) Field of the Invention

The present invention, which relates to hydraulic pumps, is particularly concerned with pumping devices having a plurality of pumping elements in a one-piece structure, thus allowing different modes of operation.

(b) Discussion of the Prior Art

There exist already several examples of one-piece pumping devices which include a plurality of pumping elements and which allow several modes of operation. Amongst the existing devices, mention must be made of the twin hydraulic pump which possesses two pumping elements, each driven by its own motor. It guarantees permanent operation, for all intents and purposes, in an installation using only one pump. The solution it provides to the requirement for permanent operation consists of including a pair of identical pumps in the same pump body, instead of one pump. The two halves of the device are operated alternately, the second element of the pair being provided to take over from the first if the latter, normally the only element operating, fails. This solution is excellent. The characteristics of each of the pumps are those of the single pump which the device replaces. Exceptionally, certain twin pumps have an additional possibility, which consists of operating both elements simultaneously. This type of operation is, nevertheless, exceptional, and normal operation of the device remains that of using only one of its elements, with the possibility of being backed up by an emergency element having the property of taking over automatically and instantly from the defective element. The very high dependability of the twin pump thus guarantees the reliability of the installation.

In a domestic or small factory environment, various types of pumping operations can arise: e.g., watering land, emptying reservoirs, removing flood water, etc. The characteristics of the pumps required for these various operations are not the same. For certain of these operations, such as watering, a high-pressure pump is required, whilst for other operations, such as pumping out flood water, a high flow-rate is required. Most of the time, however, the occasional nature of such applications does not justify the purchase of different types of equipment.

SUMMARY OF THE INVENTION

In order to meet the requirement for a multi-application pumping device, the present invention proposes a one-piece pumping device possessing at least two centrifugal pumping elements characterized by the fact that it possesses a single motor and means for interconnecting at least two elements of the pump in two different ways, one corresponding to connecting the elements in series and the other corresponding to connecting them in parallel, such that the device possesses two modes of operations whose characteristics are substantially different.

According to one aspect of the invention, the pumping device has two pump elements providing either serial or parallel coupling of the hydraulic pump elements included in its single structure and the following structure:

a rigid coaxial assembly of at least two end members on either side of a central drive, a central drive comprising a motor whose stator is provided with a surrounding moulding possessing fluid ducts providing communication between one of the pump elements and the other, or with an outlet duct, one of the two end members is fixed, whilst the other is movable, capable of assuming either of two positions relative to the fixed part of the assembly, the surfaces of the members in contact with the surfaces of the center member are shaped to form with the corresponding surfaces of the central drive a chamber surrounding a turbine wheel on either side of the drive and coupled to the shaft of the motor, the end members are also provided with lateral ducts to let through the fluid and constituting the internal hydraulic circuit of the device, and finally, the front surface of the movable member may be provided with an opening comprising the general inlet of the pumping device.

According to another aspect of the device in accordance with the invention, the shapes and contours of the ducts in the fixed and movable end members are arranged to place in communication (via the ducts through the moulding around the stator of the single mtor) the pump elements either in series for one position of the movable member or in parallel for the second position of this member, the two positions of the movable member being diametrically opposed.

According to another aspect of the invention, the pumping device is automatically primed as soon as the pump is immersed in a liquid.

The operation of the present invention will appear more clearly from the following description, said description being given with reference to the appended drawings in which:

Figure 1:
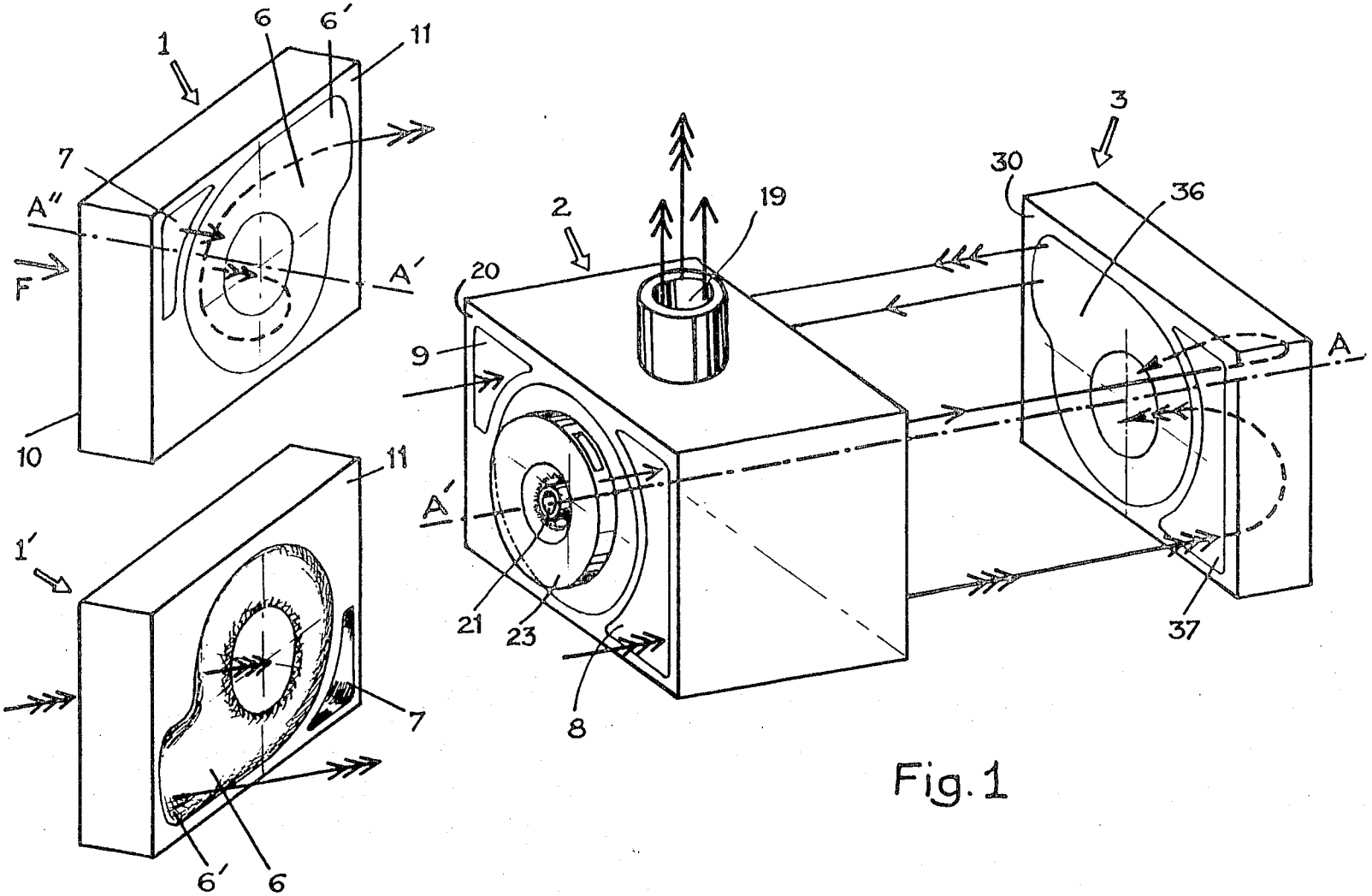
FIG. 1 is an exploded view, in perspective, of one practical form of the pumping device in accordance with the invention, the various parts being seen before assembly.
Figure 2A:
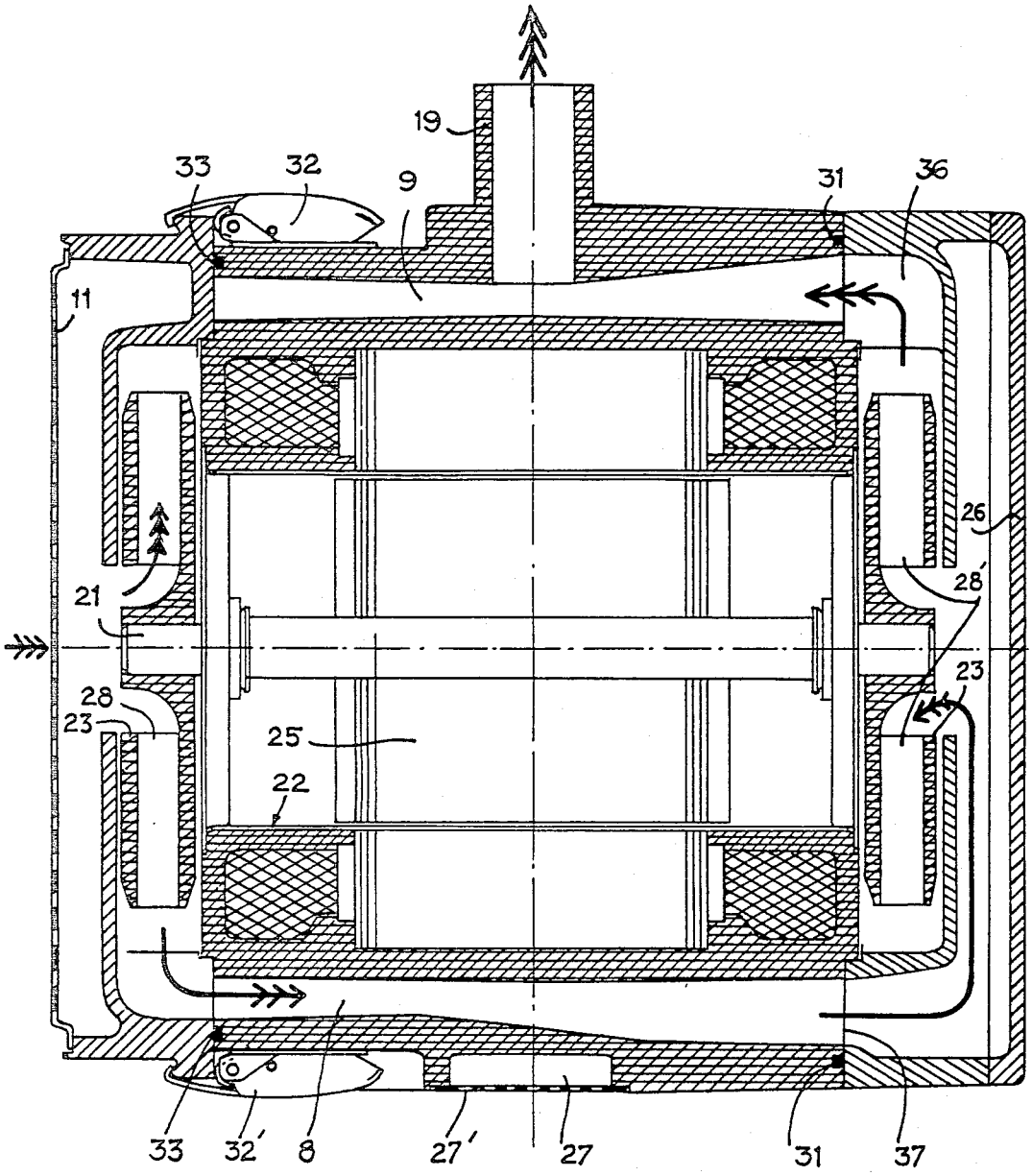
Figure 2B:
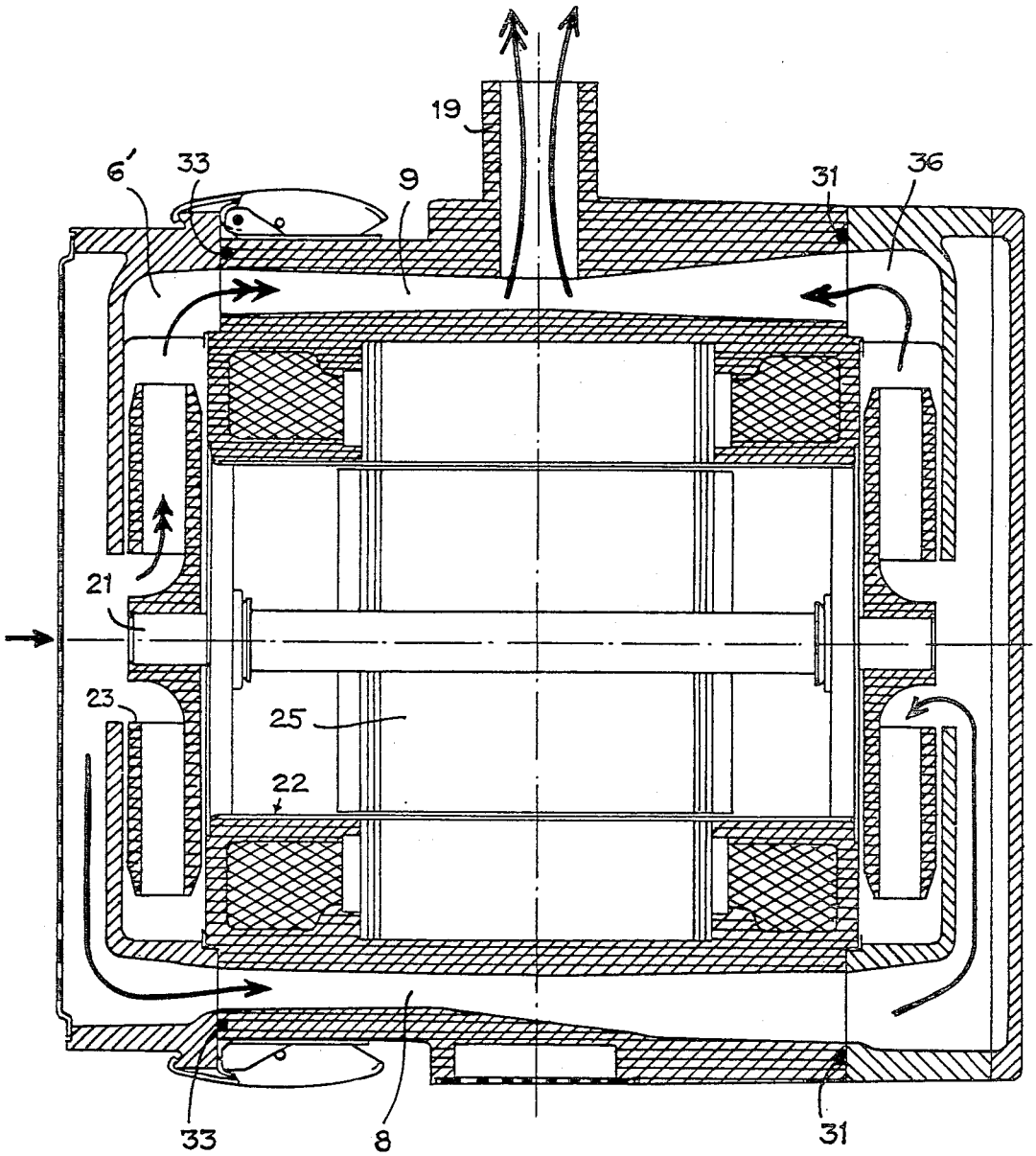
Figure 3:
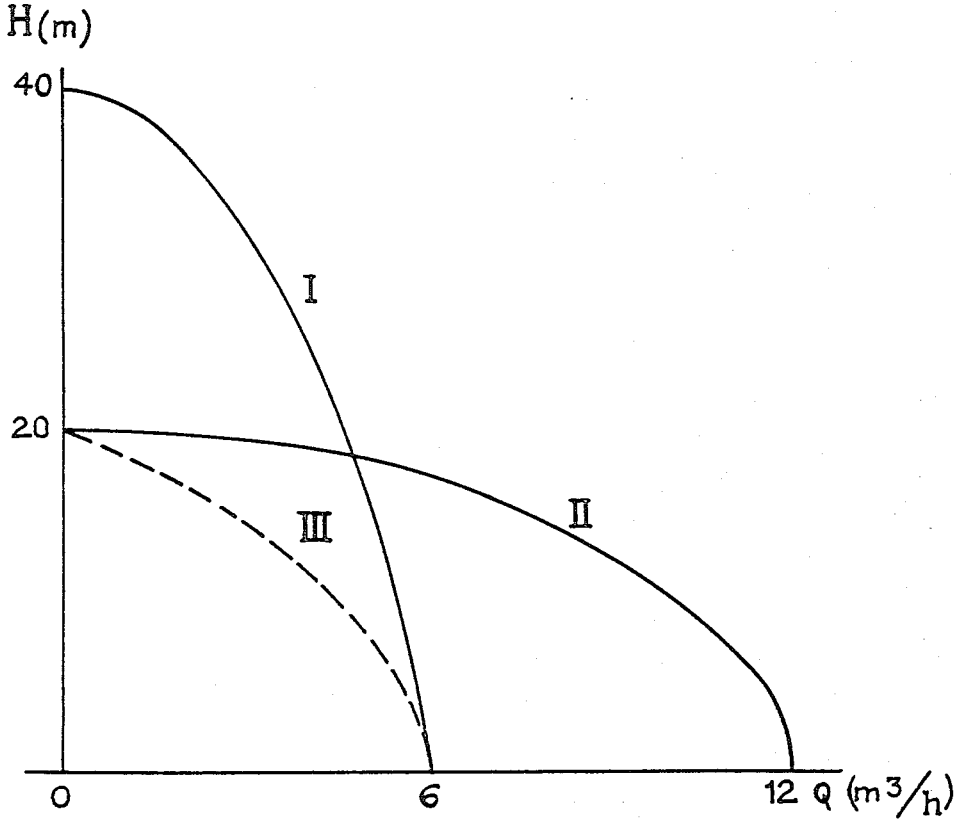

Each of the FIGS. 2*a* and 2*b* represents schematically a vertical section through the device illustrated by FIG. 1;

FIG. 2*a* illustrates the coupling in series of the two pump elements in the one-piece pumping device according to the invention;

FIG. 2*b* illustrates the coupling in parallel of the pump elements in the pumping device according to the invention;

The pressure/flow characteristics of the device according to the invention are shown in FIG. 3 for both modes of operation.

The following description refers to all three FIGS. 1, 2*a* and 2*b*.

FIG. 1 illustrates schematically the typical structure of one practical form of the pumping device according to the invention, by means of an exploded perspective view of the various parts before assembly into one piece. From left to right are seen a first end piece, the movable piece 1, shown in both positions 1 and 1', a central part, the drive 2, and a second end piece, the fixed part 3. The centre and fixed parts 2 and 3 are shown in the position for coaxial assembly along line AA'. The front surface of part 3 fits on the rear surface of the centre part 2. In the case of part 1, its centre-line A''A' coincides upon assembly with line A'A, which is the common centre-line of the one-piece structure of the device.

A continuous recess 6 is provided in the thickness of the rear surface 11 of the movable part 1. This recess is in the form of a spiral well. The spiral well or chamber 6 is open in its centre region through the thickness of the rear wall of part 1 to provide an inlet for the liquid from the front surface of the part. Beyond this region, the depth of the recess is less than the thickness of the rear wall of part 1. The spiral well or chamber 6 extends to 6', as seen in the top corner of FIG. 1. The shape of recess 6, having the print of a snail shell, constitutes an open pump chamber.

A large side opening 7 provides a duct allowing communication between the visible rear surface of the part and its front surface not visible in the figure.

The front surface 10 of part 1, which is not visible in FIG. 1, is illustrated in section by FIGS. 2*a* and 2*b*. It constitutes a partition with openings over the whole of its area. For this reason, it provides free passage to the fluid being pumped and constitutes a mesh filter protecting internal parts from any solid matter carried by the liquid being pumped.

The two illustrations 1 and 1' of the movable part explain the half-rotation through 180° in order to change this part from position 1 to position 1'.

The central part 2 is a drive in which the motor 25 (seen in FIGS. 2*a* and 2*b*) occupies most of the space. It is an electric motor whose stator is surrounded with a moulding. The French patent application filed by the present applicant on Aug. 1, 1977, and registered under N° 77 23 607, describes a procedure for over-moulding an immersed-rotor motor which can be used for producing the over-moulding of the motor of the central part. According to this procedure, the central opening of the stator is provided with a thin-walled metallic sleeve 22 to which adheres the general over-moulding of the stator. Again according to the patent application mentioned above, the body of the over-moulding possesses ducts constituting parts of hydraulic circuits. In order to create these ducts, it is merely necessary to provide corresponding cores in the hollow mould in which is performed the operation moulding the thermosetting material used for producing the general over-moulding. Item 2 in FIG. 1 illustrates the general appearance of the drive with its external over-moulding. A first large side duct 8, a second side duct 9 and, in the axial region, the shaft 21 of the motor to which is coupled turbine wheel 23 protruding from the surface 20, are seen on the front surface 20. Duct 8 continues through the over-moulding, opening on the rear surface of part 2 with a similar contour not visible in FIG. 1. Duct 9 leads to the outside via outlet 19 provided in the over-moulding itself. Finally, the external wall of the central part 2 possesses a recess 27 at the bottom protected by a flexible membrane 27'. The arrangement not shown in the figures of an electric contact operated by the position of the membrane enables the pump motor to be started automatically when immersed in the liquid to be pumped, since the membrane is pushed in by the pressure of the liquid, closing the contact of a switch which applies electrical power to motor 25. In the example described, the motor rotates at 2900 rpm.

The front surface 30 of the fixed part 3 seen in FIG. 1 possesses a recess 36 symmetrical with recess 6 already described. It possesses a duct 37. When the device is assembled, since the rear surface of the central part 2 has a turbine wheel 23' mounted on the shaft of the motor in the same manner as wheel 23 on the front, this recess 36 constitutes the chamber surrounding this turbine wheel of the second pump element. This arrangement is visible in the sectional views shown in FIGS. 2*a* and 2*b*. These figures also illustrate the communication of duct 37 with duct 8 of the central part and with the central feed opening of turbine wheel 23'.

The assembly itself is rigid and fixed between parts 2 and 3 by mechanically fixing these two parts together. The assembly is made watertight by the seal 31 seen in FIG. 2*a*. The movable part is assembled to the remainder of the device by means of a pair of quick-release fasteners such as snap-fastener 32 in FIG. 2*a*. The bearing surface presses against the seal 33 when fasteners 32 and 32' are closed. In order to change from position 1 to position 1', fasteners 32 and 32' are opened to release part 1, which can then be rotated through 180° before closing the fasteners again, the movable part then being in position 1' on surface 20. By means of this simple operation, the device can be changed from the position coupling the pump elements in parallel to that coupling them in series.

With regard to the operation of the device, it is necessary to distinguish between the two types of operation corresponding to the two configurations determined by the two possible positions of the movable part 1.

Coupling of the Two Pump Elements in Series (FIGS. 1 and 2*a*)

The moving part is assembled in position 1' illustrated in FIG. 1 (in the bottom left corner of the figure). It is seen that the assembly surface 11 possesses no duct in its upper part. In the lower part of this assembly surface, recess 6 possesses in its extended part 6' an open recess which is positioned opposite the lower part of duct 8, whilst duct 7 is closed against the full wall of the bottom left corner of surface 20 of the drive 2. Fluid can thus flow to the central part from 6' to 8, there being no other possible passage. The arrow with three heads indicates the useful circuit. The liquid being pumped enters through the front opening in part 1', is drawn in through the opening 28 of turbine wheel 23, passes round recess 6 leaving from the area 6', and passes through duct 8 to duct 37, where it is fed to the opening 28' of the second turbine wheel 23'. It then passes round recess 36, enters duct 9 and finally leaves through outlet 19.

The two pump elements are thus coupled in series. The liquid is pumped in succession by the first element consisting of the first turbine wheel 23 and the first chamber 6, and then by the second element consisting of the second turbine wheel 23' and the second chamber 36. A single motor 25 drives both pump elements mounted on the same shaft.

Turbine wheels 23 and 23' are perfectly symmetrical, i.e. their blades are oriented in opposite directions.

Coupling of the Two Pump Elements in Parallel (FIGS. 1 and 2*b*)

The movable part is in position 1 as shown in FIG. 1 (top left corner of the figure). It is seen that the assembly surface 11 possesses no duct at the bottom. The duct 7 at the top is positioned opposite the top of duct 8, and the extended open part 6' of recess 6 is positioned opposite duct 9 in the drive 2. The fluid thus has two paths through the drive 2. This situation is expressed in FIGS. 1 and 2*b* by the arrows with one and two heads. The liquid being pumped is drawn in as illustrated by arrow F through the front opening in the movable part 1. It feeds (arrow with one head) the central opening of the turbine wheel 23′ of the second pump element by passing through opening 7 and duct 8. The liquid passes around chamber 36 and thence to the outlet 19 via duct 9. It also feeds the central opening of turbine wheel 23 of the pump element. The liquid passes around chamber 6 of this first element and then through channel 9 to the outlet 19. This second hydraulic path is identified by the two-headed arrows. The arrows with two heads have the same meaning in FIG. 2*b*, which illustrates the assembly of the device and the internal hydraulic circuit when the two elements of the pump are coupled in parallel. It is seen that when the movable part is in its second position, the two elements of the pump are coupled in parallel, since the part of the incoming fluid (represented by arrow F) is pumped by the first pump element (23 and 6), whilst the other part is pumped by the second pump element (23′ and 36).

This results in two very different characteristics of the device, as shown in FIG. 3.

In FIG. 3, the pressure/flow characteristics of the serial and parallel configurations are plotted in the same diagram. The flow-rate Q in cubic meters per hour is plotted horizontally, whilst the outlet pressure H expressed as meters of water column is plotted vertically. Curve I is the pressure/flow characteristic of the serial configuration. For a flow-rate of 6 cubic meters per hour, the pressure reaches 40 meters of water column. Curve II is the pressure/flow characteristic of the parallel configuration. The device produces a flow-rate of 12 cubic meters per hour for a pressure of 20 meters of water column. The third curve III (dashed line) is the characteristic of one pump element by itself.

This graph shows that the single device allows accentuated differentiation of the characteristics.

If, for example, the application requires high-flow pumping, the parallel configuration is used. This is the case, for example, of pumping out a tank or flooded basement. If on the contrary the application requires high-pressure pumping, the serial configuration is used. This is the case, for example, when watering land.

The device according to the invention provides a solution to the requirement for pumping with different characteristics, for which no equipment was sufficiently flexible prior to the invention. The parts constituting the device can be made from light-weight metal, such as aluminium or light alloy for the movable part 1 and the fixed part 3. The drive, consisting of a single motor with a resin over-moulding, is light-weight and low-cost. It follows that manufacture is simple and the size of the device is minimal. The possibility of providing automatic pump motor starting makes it very simple to handle the device.

Filtering the liquid at the inlet avoids failure and damage of internal parts. When the pumping device according to the invention is used for pumping water or liquid carrying solid matter, it is preferable to use turbine wheels having a small number of channels of minimum wetted peripheral section. In particular, turbine wheels possessing 5 or less channels have been successfully operated. Each channel or blade had a large and approximately square cross-section to facilitate the evacuation of particles without damaging either the turbine wheel or internal parts. These arrangements make the equipment rugged and reliable in spite of very severe working conditions.

The flow of liquid through the ducts provided in the motor over-moulding has the advantage of cooling the over-moulding material, which is generally a poor thermal conductor.

Using the means described by the invention, several variants can be made without going beyond the scope of the invention. In particular, parallel/serial coupling can be extended to multiple pump elements.

Although the principles of the present invention are described above in connection with specific practical examples, it should be clearly understood that the said description is given as an example only and does not limit the scope of the invention.

We claim:

1. A pumping device having two modes of operation and including at least two centrifugal pump elements connected to a single device motor characterized by:

a one-piece structure for said pumping device, said one-piece structure including means for providing serial or parallel coupling configurations for said centrifugal pump elements; and means for changing from one of said coupling configurations to the other;

wherein said one-piece structure comprises:

a central member including said drive motor;

a first end member fixedly mounted to and communicating with said central member and including a first continuous recess for receiving a first one of said at least two centrifugal pump elements;

a second end member detachably mounted to and communicating with said central member and including a second continuous recess for receiving a second one of said at least two centrifugal pump elements, said drive motor including a drive shaft with said at least two centrifugal pump elements being co-axially mounted to opposite ends of said shaft, said central member and said first and second end members being co-axially positioned with respect to said drive shaft, said configuration changing means comprising:

means for releasably securing said second end member to said central member in either of two different positions, each of said positions corresponding to one of the coupling configurations of the pump elements and hence to one of the two operating modes.

2. A pumping device according to claim 1 wherein said central member includes a plurality of fluid ducts providing communication between one pump element and the other and allowing evacuation of said fluid, said first and second continuous recesses comprising first and second recessed pump chambers each completed by a corresponding fluid access duct, one pump chamber being associated with each end member.

3. A pumping device according to claim 2 wherein said first and second end members each further include an end duct, the shape and contour of the end ducts and continuous recesses in said fixedly mounted and detachably mounted end members being configured such that they align with the fluid ducts in said central member to place said first and second pump elements in series for the first of the two different positions of said second end member and in parallel for the second of said two different positions.

4. A pumping device according to claim 3 wherein said two different positions comprise opposing faces of said second end member such that a 180° rotation of said second end member changes the coupling configuration of said at least two pump elements from a series coupling to a parallel coupling and vice-versa.

5. A pumping device according to claim 3 wherein said second end member further includes a general inlet comprising a partition in said end member with an opening therethrough.

6. A pumping device according to claim 3 wherein said drive motor is encased in a moulding of thermo-setting plastic, said fluid ducts comprising longitudinal recesses in said moulding.

7. A pumping device according to claim 6 wherein said moulding further comprises a common outlet for said fluid.

8. A pumping device according to claim 6 further including means responsive to the immersion of the device in a fluid, for automatically energizing said drive motor.

9. A pumping device according to claim 6 wherein each of said centrifugal pump elements comprises a turbine wheel having no more than five blades, the section of each blade having a minimum wetted perimeter.

* * * * *